US011345578B1

(12) United States Patent
Montes et al.

(10) Patent No.: US 11,345,578 B1
(45) Date of Patent: May 31, 2022

(54) BELT-WEARABLE PRY BAR

(71) Applicant: Phase 5 Weapon Systems Inc., Roseville, CA (US)

(72) Inventors: Kenneth Montes, Roseville, CA (US); Leon A. Wauters, Roseville, CA (US)

(73) Assignee: Phase 5 Weapon Systems Inc., Roseville, CA (US)

( * ) Notice: Subject to any disclaimer, the term of this patent is extended or adjusted under 35 U.S.C. 154(b) by 483 days.

(21) Appl. No.: 16/664,647

(22) Filed: Oct. 25, 2019

Related U.S. Application Data

(60) Provisional application No. 62/750,624, filed on Oct. 25, 2018.

(51) Int. Cl.
*B66F 15/00* (2006.01)
*A45F 5/02* (2006.01)

(52) U.S. Cl.
CPC ..... *B66F 15/00* (2013.01); *A45F 5/021* (2013.01); *A45F 2200/0575* (2013.01)

(58) Field of Classification Search
CPC .. B25C 11/00; A45F 2200/0575; A45F 5/021; A45F 5/00; B25B 27/00; B66F 15/00; E04D 15/003; E04G 2023/085; Y10S 224/904
USPC ..... 224/587, 904
See application file for complete search history.

(56) References Cited

U.S. PATENT DOCUMENTS 3,134,574 A 5/1964 Reuterfors
D265,506 S * 7/1982 Finamore ..... D32/49
D276,695 S 12/1984 Hanna
4,638,521 A * 1/1987 Potente ..... A46B 9/005 15/117
D302,234 S 7/1989 McNamee et al.
5,207,126 A * 5/1993 Schaben ..... E04D 15/003 7/166
D341,529 S 11/1993 Jacobs
5,322,264 A 6/1994 Giambro
5,695,171 A * 12/1997 Shine ..... B25C 11/00 254/25
5,695,172 A 12/1997 Hreha
5,916,228 A * 6/1999 Ripich ..... A61B 17/244 606/161
D444,690 S 7/2001 Bond
6,308,355 B1 10/2001 McMillan et al.
D473,765 S 4/2003 Gordon
6,598,857 B1 * 7/2003 Hernandez ..... B66F 15/00 254/21
6,651,855 B1 11/2003 Flynn
6,679,404 B2 * 1/2004 Brandt ..... A45F 5/00 224/672
6,752,380 B1 6/2004 Taylor et al.
6,959,473 B1 11/2005 Anibas
D552,799 S 10/2007 Williams
(Continued)

*Primary Examiner* — Adam J Waggenspack

(74) *Attorney, Agent, or Firm* — Law Office of Andrei D Popovici, PC

(57) ABSTRACT

In some embodiments, a pry bar is shaped to be conveniently worn along the belt by an operator such as a law enforcement officer. The pry bar includes a curved lever arm having a curvature that matches an operator's waist, and a prying ridge extending inward from a longitudinal end of the curved lever arm. The inward orientation of the prying ridge reduces the lever action of the pry bar, but allows the operator to conveniently carry the pry bar on the waist without snagging on external objects.

17 Claims, 6 Drawing Sheets

(56) References Cited

U.S. PATENT DOCUMENTS

| | | | | |
|---|---|---|---|---|
| D567,760 | S | 4/2008 | Parrish et al. | |
| 7,774,882 | B2 | 8/2010 | Liou | |
| 8,517,341 | B2 | 8/2013 | Edwards | |
| 8,567,760 | B2 | 10/2013 | Sindt | |
| 8,777,077 | B2 | 7/2014 | McClain | |
| 8,955,827 | B2 | 2/2015 | Brown | |
| D729,598 | S | 5/2015 | Sagawa | |
| D790,944 | S | 7/2017 | Wise | |
| 10,100,543 | B2 * | 10/2018 | Hanson | E04G 23/08 |
| D867,094 | S | 11/2019 | Rowley | |
| D883,766 | S | 5/2020 | Montes et al. | |
| 2005/0056816 | A1 | 3/2005 | Pieper | |
| 2005/0062026 | A1 * | 3/2005 | Holcomb | B25C 11/00 254/25 |
| 2011/0296955 | A1 * | 12/2011 | Silvers | B67B 7/44 81/3.55 |

* cited by examiner

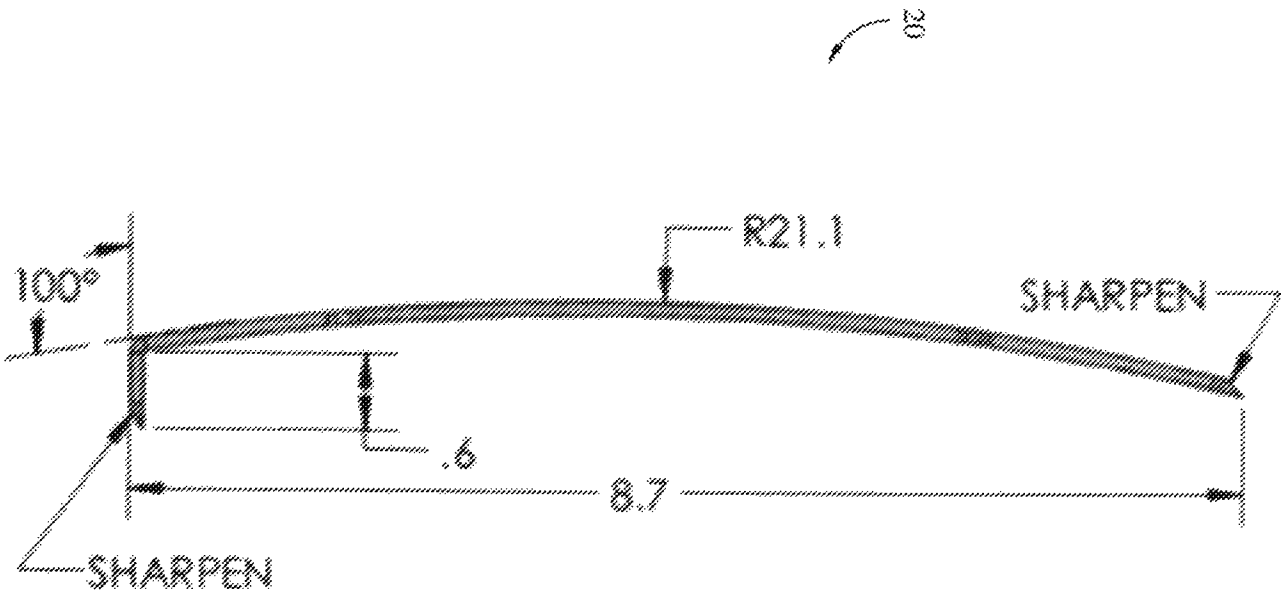
FIG. 5-A

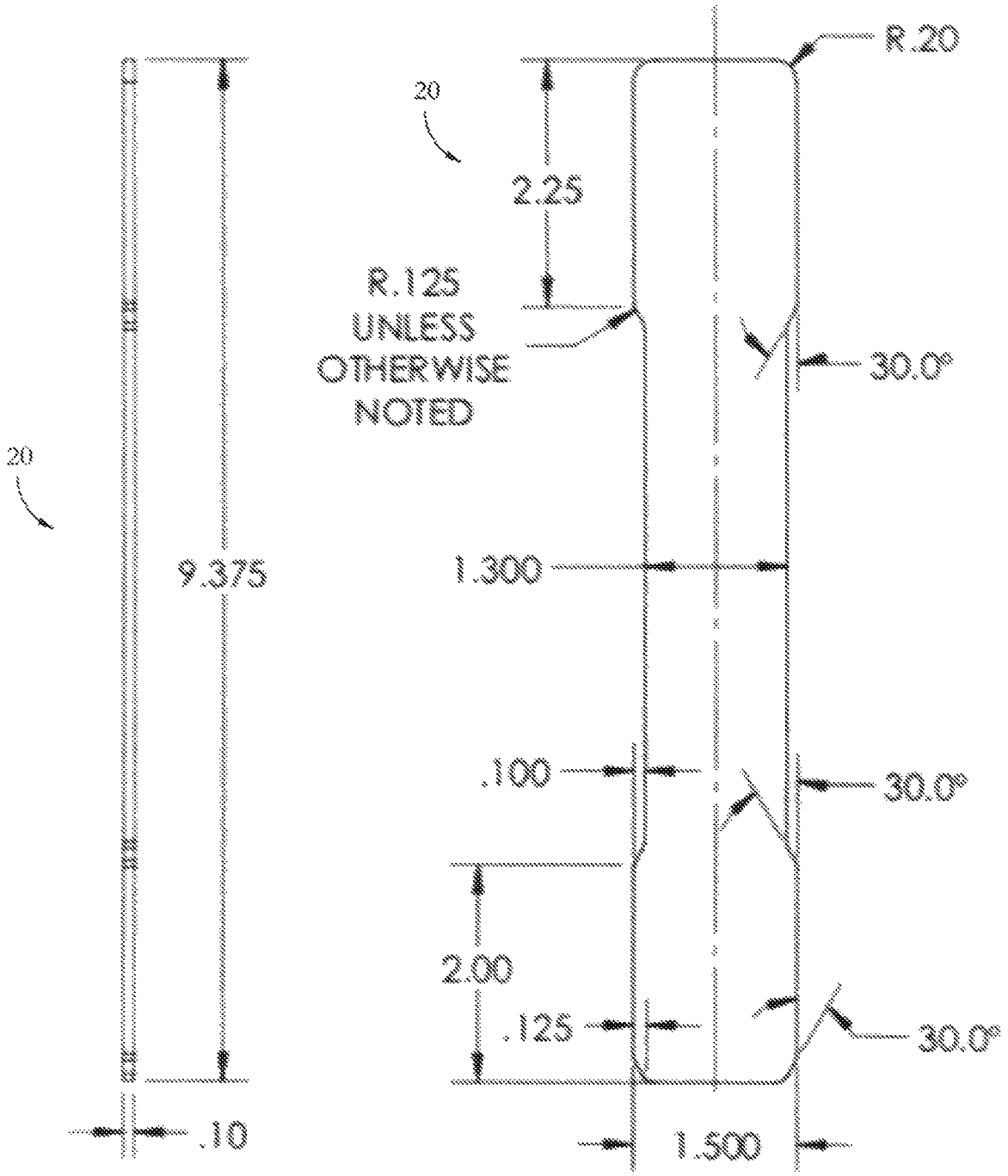
FIG. 5-B

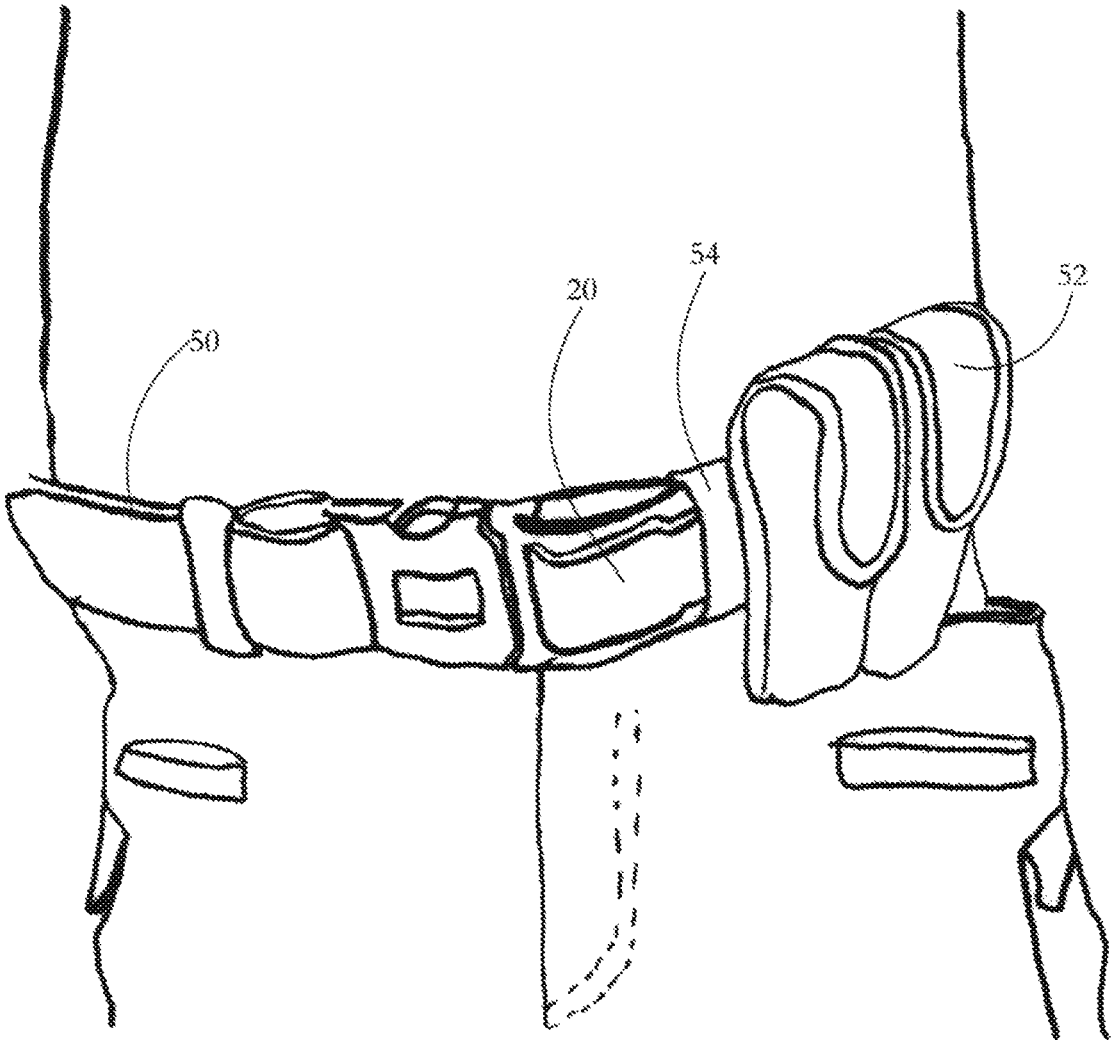
FIG. 6-A

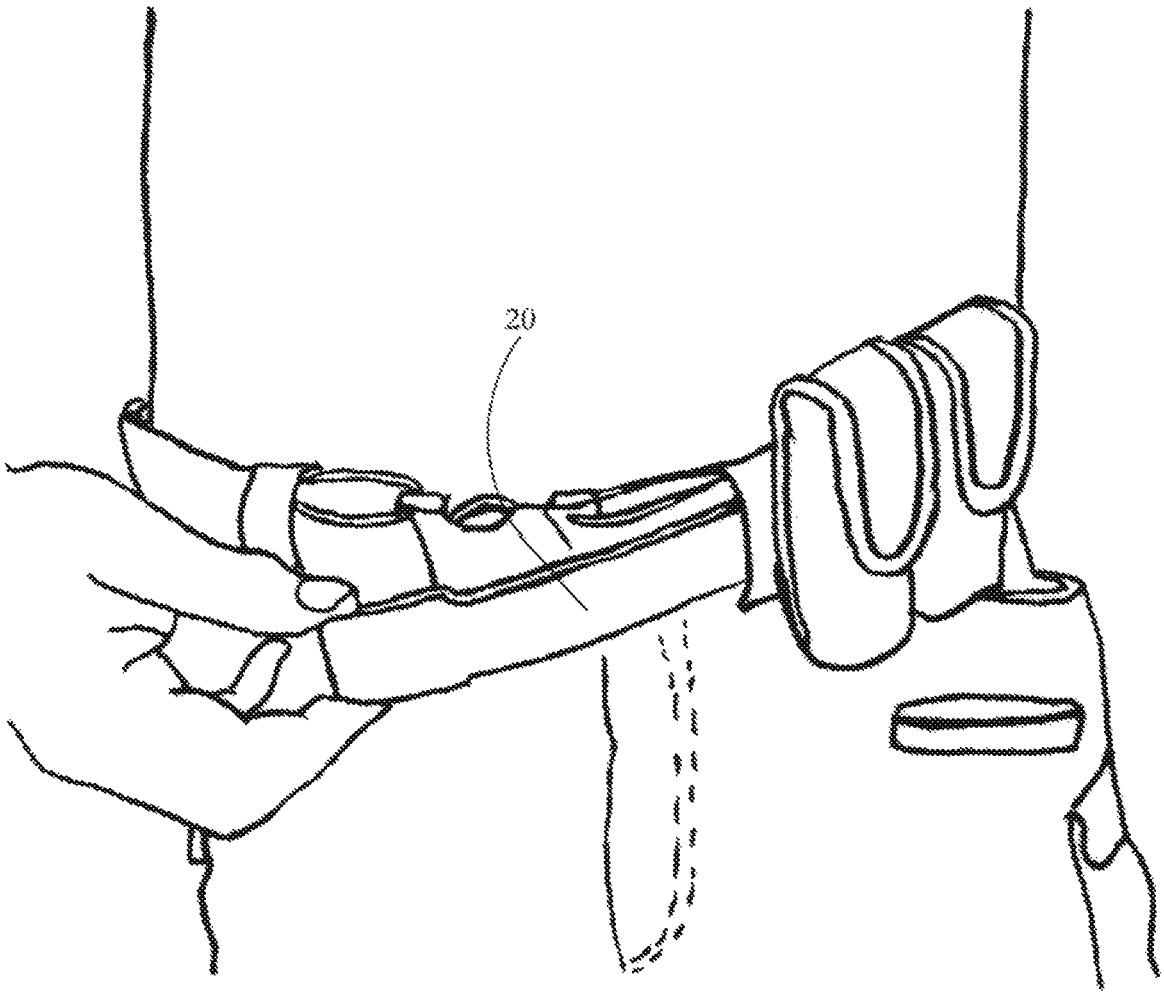
FIG. 6-B

BELT-WEARABLE PRY BAR

CROSS-REFERENCE TO RELATED APPLICATIONS

This application claims the benefit of the filing date of U.S. Provisional Patent Application No. 62/750,624, filed Oct. 25, 2018, titled "Belt-Wearable Pry Bar," which is incorporated herein by reference.

BACKGROUND OF THE INVENTION

This invention relates to pry bars, and particularly to pry bars designed to be used by law enforcement personnel.

Pry bars are hand tools used to pry apart objects by inserting one end of the pry bar in a space between the objects, and applying a force on the opposite, free end of the pry bar in order to leverage the applied force into a larger force acting to separate the objects.

Conventional pry bar tool designs are often concerned with improving the ability of the tool to apply desired forces, and/or providing versatile multi-function tools.

Exemplary stand-alone pry bar designs are described in U.S. Pat. Nos. 6,752,380, 5,695,172, and 5,695,171, among others. Exemplary pry bars that form part of a multi-function tool are described in U.S. Pat. Nos. 7,774,882 and 6,308,355, among others.

In US Patent Application Publication No. 2005/0056816, Pieper describes a pry bar tool for removing embedded fasteners or unwanted building materials. The pry bar has a lever with a claw at one end and a handle fixedly secured along its top surface. The lever is an elongated, arcuate member that provides leverage to decrease the amount of force that needs to be applied to the pry tool.

SUMMARY OF THE INVENTION

According to one aspect, a pry bar shaped to facilitate being carried along a user's belt comprises: a convexly-curved lever arm shaped as a strip having a length between five and fifteen inches, a width between one and two inches, and a thickness between 0.05 and 0.25 inches, wherein a curvature of the lever arm is characterized by a radius of curvature between 15 and 25 inches; and an inwardly-protruding prying ridge extending generally transversely from a distal end of the lever arm, the prying ridge extending on a convex side of the lever arm, the prying ridge having a length between 0.25 inches and 1 inch, a width between one and two inches, and a thickness between 0.05 and 0.25 inches.

According to another aspect, a method of making a pry bar comprises cutting a strip of metal from a starting plate; and bending the strip of metal to form a pry bar. The pry bar comprises a convexly-curved lever arm shaped as a strip having a length between five and fifteen inches, a width between one and two inches, and a thickness between 0.05 and 0.25 inches, wherein a curvature of the lever arm is characterized by a radius of curvature between 15 and 25 inches, and an inwardly-protruding prying ridge extending generally transversely from a distal end of the lever arm, the prying ridge extending on a convex side of the lever arm, the prying ridge having a length between 0.25 inches and 1 inch, a width between one and two inches, and a thickness between 0.05 and 0.25 inches.

BRIEF DESCRIPTION OF THE DRAWINGS

The foregoing aspects and advantages of the present invention will become better understood upon reading the following detailed description and upon reference to the drawings where:

FIG. 5-A shows a side view of the belt-wearable pry bar of FIG. 1 illustrating exemplary dimensions according to some embodiments of the present invention.

FIG. 5-B shows side and top views illustrating exemplary dimensions of a precursor metal strip which may be bent/curved to manufacture the belt-wearable pry bar of FIG. 1 according to some embodiments of the present invention.

FIG. 6-A shows a view of the belt-wearable pry bar of FIG. 1 as worn along an operator's belt according to some embodiments of the present invention.

FIG. 6-B illustrates the removal of a belt-wearable pry bar of FIG. 1 from an operator's waist according to some embodiments of the present invention.

DETAILED DESCRIPTION

The following description illustrates the present invention by way of example and not necessarily by way of limitation. A set of elements includes one or more elements. A plurality of elements includes two or more elements. Any recitation of an element is understood to refer to at least one element. Unless otherwise required, any described method steps need not be necessarily performed in a particular illustrated order. Any recited connection encompasses a direct connection as well as an indirect connection through an intermediary structure.

Figure 1:
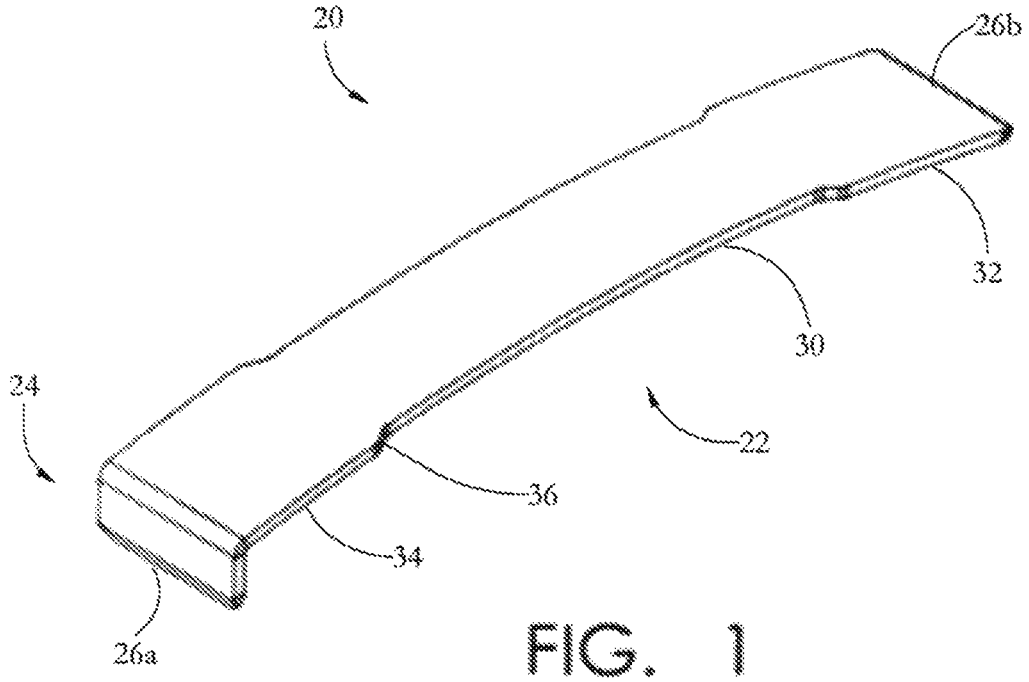
FIG. 1 shows a top isometric view of a belt-wearable pry bar according to some embodiments of the present invention.
Figure 2:
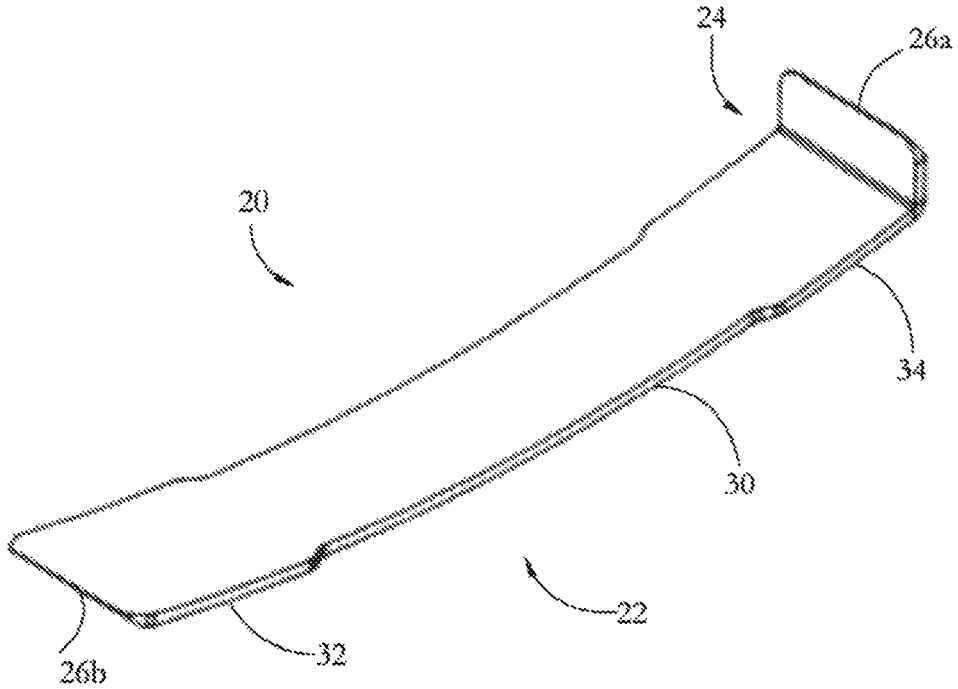
FIG. 2 shows a bottom isometric view of the belt-wearable pry bar of FIG. 1 according to some embodiments of the present invention.
Figure 3:
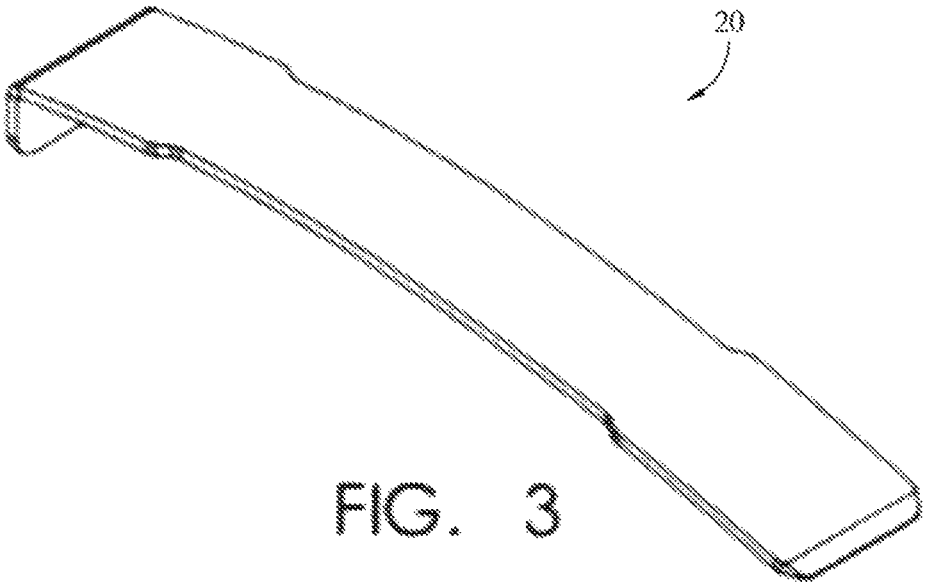
FIG. 3 shows another top isometric view of the belt-wearable pry bar of FIG. 1 according to some embodiments of the present invention.
Figure 4:
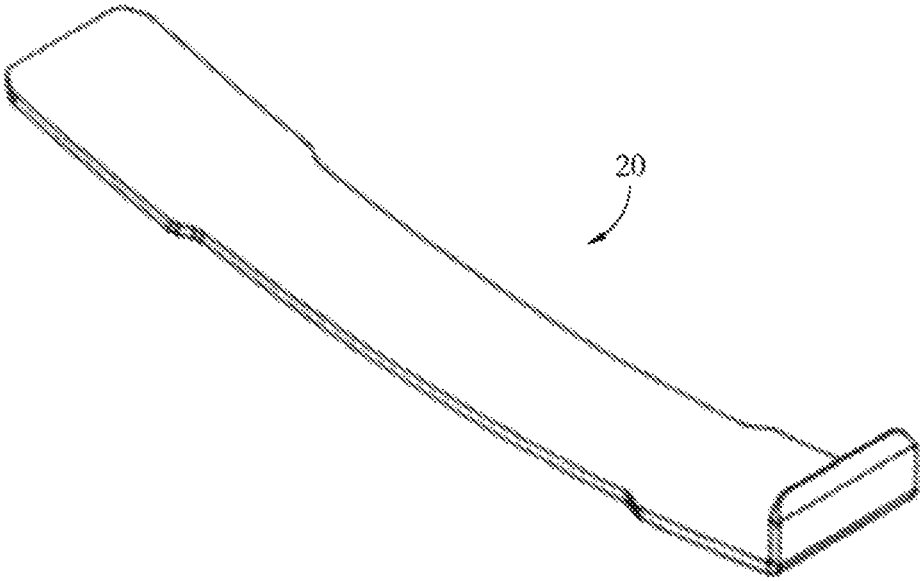
FIG. 4 shows another bottom isometric view of the belt-wearable pry bar of FIG. 1 according to some embodiments of the present invention.

FIG. 1 shows a top isometric view of a belt-wearable pry bar 20 according to some embodiments of the present invention. Pry bar 20 may be used by law enforcement officers such as special weapons and tactics (SWAT) operators, or other users, for breaching (forcibly opening) or otherwise overcoming doors (e.g. screen doors), gates, locks or other barriers to entry into buildings or other locations. In particular, pry bar 20 is sized and shaped to be hand-held, and used as a lever while inserted in a narrow opening defined between two adjacent objects (e.g. a door and a corresponding door-jamb) to pry apart the two objects. Additionally, pry bar 20 is convexly curved as described below, to facilitate wearing pry bar 20 on a user's waist, along the length of a user's belt, without externally exposing the sharp insertion (prying) end(s) of pry bar 20. The convex curvature facilitates easily carrying and extracting pry bar 20 in the field, without exposing the insertion end(s) to possible objects that could be snagged by the insertion end(s).

As shown in FIGS. 1-4, pry bar 20 includes a convexly-curved lever arm 22 defining a generally-longitudinal direction, and a prying ridge 24 extending transversely (e.g. perpendicularly) away from lever arm 22 toward the inner side of lever arm 22. A first prying edge 26*a* is defined at a distal end of prying ridge 24, and a second prying edge 26*b* is defined at the opposite end of lever arm 22. Prying edges 26*a-b* are ground/sharpened to dull points, narrower than the corresponding supporting structure so as to facilitate insertion between close structures, but not sharp enough to cut.

Lever arm 22 includes proximal and distal end sections 32, 34 having the same width as prying ridge 24, and a central handle section 30 interconnecting end sections 32, 34. Handle section 30 has a longitudinal extent sized to fit a human hand, and has a narrower width than end sections 32, 34, to facilitate an end user's gripping lever arm 22 without lever arm 22 sliding longitudinally out of the user's hand. In some embodiments, central handle section 30 may have other indentations or protrusions to facilitate longitudinal stability, such as grooves along the minor and/or major faces of lever arm 22 sized to fit one or more human fingers.

FIG. 5-A-B show exemplary dimensions of various features of pry bar 20 according to some embodiments of the present invention. A radius of curvature of the lever arm is illustrated as about 20 inches (e.g. 21.1 inches). In some embodiments, a higher or lower radius of curvature may be used, for example a radius between 10 and 30 inches, more specifically between 15 and 25 inches. If a human waist were perfectly circular, a waist that is 40 inches in length would correspond to a radius of curvature of about 40/2*3.14 inches, or about 7 inches. Human waists are not perfectly circular, however, and the left or right side of the front of a human has a generally higher radius of curvature. A radius of curvature of about 20-25 inches was observed to provide generally a good fit for the waist of a fit male, such as a police/SWAT operator. In the illustrated embodiment, the radius of curvature is uniform along the entire length of the pry bar. In some embodiments, the radius of curvature may have varying values along the length of the pry bar, for example if the lever arm is shaped to be curved but not precisely circular (i.e. with an elliptical, quasi-elliptical, quasi-circular or other curved cross section). In some embodiments, an angle defined between the prying ridge and the lever arm at a location of contact between the prying ridge and the lever arm is between 90 and 110 degrees, for example approximately 100 degrees as shown in FIG. 5-A. A width between 1 and 2 inches, e.g. about 1.5 inches (1.3 along the handle portion), allows convenient carrying along belts worn by law enforcement professionals. A prying ridge length between 0.25 and 1 inch, for example between 0.5 and 0.7 inches, specifically about 0.6 inches, may be used in some embodiments.

An overall longitudinal lever arm extent between 5 and 15 inches, for example between 8 and 12 inches, specifically about 9 inches, may be used in some embodiments. FIG. 5-B illustrates an exemplary flat length of 9.375 inches, corresponding to a curved shape projection having a length of 8.7 inches. A width of the device may be between 1/16 and 3/8" in some embodiments, for example about 1/8" to 1/4".

FIG. 6-A-B show several views of a pry bar 20 as held along the length of a user's belt 50, beneath one or more belt loops 54 and/or pockets/enclosures 52 attached to belt 50. In some embodiments, a pry bar 20 may also be held in a pocket/enclosure attached to belt 50. As shown, pry bar 20 follows the natural curvature of belt 50 when pry bar 20 is held with the prying ridge inward. Holding pry bar 20 with the prying ridge inward reduces the risk that the prying ridge will snag on external objects. In some embodiments, a human operator wears the pry bar as shown in FIG. 6-A, extracts the pry bar when needed as shown in FIGS. 6-B, and pries open two closely-spaced objects using either the pry ridge or the opposite end of the lever arm, as needed.

Curving the pry bar convexly facilitates carrying the pry bar along a user's waist, even though the convex curvature may reduce the leverage provided by the pry bar. Even though the convex curvature may reduce the effectiveness of the prying action of the pry bar, the convex curvature improves its usability for law enforcement professionals or other users who need to carry and be able to quickly access many different pieces of equipment.

In some embodiments, pry bar 20 is made of steel or another metal/alloy with similar mechanical strength. In some embodiments, a starting flat piece is cut out of a steel plate, formed and bent, and then heat-treated to yield a monolithic pry bar formed out of a single piece of metal. The starting piece is oriented so that the metal grain direction is longitudinal, along the length of the pry bar.

As will be apparent to the skilled artisan, the exemplary embodiments described above may be modified without departing from the scope of the invention.

What is claimed is:

1. A pry bar shaped to facilitate being carried along a user's belt, the pry bar comprising:

a convexly-curved lever arm shaped as a strip having a length between five and fifteen inches, a width between one and two inches, and a thickness between 0.05 and 0.25 inches, wherein a curvature of the lever arm is characterized by a radius of curvature between 15 and 25 inches; and an inwardly-protruding prying ridge extending generally transversely from a distal end of the lever arm, the prying ridge extending on a convex side of the lever arm, the prying ridge having a length between 0.25 inches and 1 inch, a width between one and two inches, and a thickness between 0.05 and 0.25 inches.

2. The pry bar of claim 1, wherein the strip has a length between eight and twelve inches.

3. The pry bar of claim 1, wherein the radius of curvature characterizing the lever arm is uniform along an entire length of the lever arm.

4. The pry bar of claim 1, wherein the prying ridge has a length between 0.5 and 0.7 inches.

5. The pry bar of claim 1, wherein each of the prying ridge and an end of the lever arm opposite the prying ridge has a sharpened edge.

6. The pry bar of claim 1, wherein the lever arm comprises a narrowed central handle section for facilitating gripping the lever arm.

7. The pry bar of claim 1, wherein an angle defined between the prying ridge and the lever arm at a location of contact between the prying ridge and the lever arm is between 90 and 110 degrees.

8. The pry bar of claim 1, wherein the pry bar is formed from a metal having a grain direction oriented along the length of the lever arm.

9. A method of using a pry bar, comprising:

placing a pry bar along the length of an operator's belt, wherein the pry bar comprises a convexly-curved lever arm shaped as a strip having a length between five and fifteen inches, a width between one and two inches, and a thickness between 0.05 and 0.25 inches, wherein a curvature of the lever arm is characterized by a radius of curvature between 15 and 25 inches, and an inwardly-protruding prying ridge extending generally transversely from a distal end of the lever arm, the prying ridge extending on a convex side of the lever arm, the prying ridge having a length between 0.25 inches and 1 inch, a width between one and two inches, and a thickness between 0.05 and 0.25 inches removing the pry bar from its location along the length of the operator's belt, for use in prying apart structures.

10. A method of making a pry bar, comprising:

cutting a strip of metal from a starting plate; and bending the strip of metal to form a pry bar comprising a convexly-curved lever arm shaped as a strip having a length between five and fifteen inches, a width between one and two inches, and a thickness between 0.05 and 0.25 inches, wherein a curvature of the lever arm is characterized by a radius of curvature between 15 and 25 inches, and an inwardly-protruding prying ridge extending generally transversely from a distal end of the lever arm, the prying ridge extending on a convex side of the lever arm, the prying ridge having a length between 0.25 inches and 1 inch, a width between one and two inches, and a thickness between 0.05 and 0.25 inches.

11. The method of claim 10, wherein the strip has a length between eight and twelve inches.

12. The method of claim 10, wherein the radius of curvature characterizing the lever arm is uniform along an entire length of the lever arm.

13. The method of claim 10, wherein the prying ridge has a length between 0.5 and 0.7 inches.

14. The method of claim 10, wherein each of the prying ridge and an end of the lever arm opposite the prying ridge has a sharpened edge.

15. The method of claim 10, wherein the lever arm comprises a narrowed central handle section for facilitating gripping the lever arm.

16. The method of claim 10, wherein an angle defined between the prying ridge and the lever arm at a location of contact between the prying ridge and the lever arm is between 90 and 110 degrees.

17. The method of claim 10, wherein the pry bar is formed from a metal having a grain direction oriented along the length of the lever arm.

* * * * *